US008353789B2

(12) United States Patent
Madson et al.

(10) Patent No.: US 8,353,789 B2
(45) Date of Patent: Jan. 15, 2013

(54) GOLF BALL WITH ROTATIONAL PROTRUSIONS WITHIN A DIMPLE

(75) Inventors: Michael R. Madson, Pawtucket, RI (US); Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 700 days.

(21) Appl. No.: 12/475,891

(22) Filed: Jun. 1, 2009

(65) Prior Publication Data

US 2010/0304897 A1 Dec. 2, 2010

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | | |
|---|---|---|---|---|
| 6,162,136 | A | 12/2000 | Aoyama | |
| 6,383,092 | B1 | 5/2002 | Ogg | |
| 6,569,038 | B2 | 5/2003 | Sullivan | |
| 6,632,150 | B1 | 10/2003 | Ogg | |
| 6,958,020 | B1 | 10/2005 | Ogg et al. | |
| 7,041,013 | B2 | 5/2006 | Ohama et al. | |
| 7,179,177 | B2 * | 2/2007 | Kennedy, III | 473/383 |
| 7,207,905 | B2 * | 4/2007 | Aoyama | 473/384 |
| 7,476,163 | B2 * | 1/2009 | Kasashima | 473/383 |
| 2005/0090335 | A1 * | 4/2005 | Kennedy, III | 473/383 |
| 2006/0073915 | A1 * | 4/2006 | Aoyama | 473/378 |
| 2008/0058124 | A1 * | 3/2008 | Simonds et al. | 473/383 |
| 2008/0125250 | A1 * | 5/2008 | Lee | 473/383 |

* cited by examiner

*Primary Examiner* — Raeann Gorden
(74) *Attorney, Agent, or Firm* — D. Michael Burns

(57) ABSTRACT

A golf ball includes an outer land surface and a plurality of dimples formed thereon. The dimples comprise protrusions on the inner surface of the dimple to energize or agitate the airflow over the dimpled surfaces to increase the aerodynamic performance of the golf ball. These protrusions include rotational elements arranged in various configurations and are fully contained within the dimple perimeter and do not extend beyond a chordal plane of the dimple. By improving the aerodynamic of the airflow over the dimpled surface of the golf ball, the outer land surface of the golf ball may remain robust to prevent premature wear and tear on the golf ball.

6 Claims, 8 Drawing Sheets

GOLF BALL WITH ROTATIONAL PROTRUSIONS WITHIN A DIMPLE

FIELD OF THE INVENTION

The present invention relates to golf balls, specifically, to a golf ball with protrusions on the inner surface of the dimples. And more particularly, the protrusions being rotational elements contained within the perimeter of the dimples.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities and thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference portion of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference portion of each dimple is important in optimizing this flow phenomenon, as well.

By using dimples to decrease drag and increase lift, almost every golf ball manufacturer has increased their golf ball flight distances. In order to optimize ball performance, it is desirable to have a large number of dimples, hence a large amount of dimple circumference, which are evenly distributed around the ball. In arranging the dimples, an attempt is made to minimize the space between dimples, because such space does not improve aerodynamic performance of the ball. In practical terms, this usually translates into 300 to 500 circular dimples with a conventional-sized dimple having a diameter that ranges from about 0.120 inches to about 0.180 inches.

One approach for maximizing the aerodynamic performance of golf balls is suggested in U.S. Pat. No. 6,162,136 ("the '136 patent), wherein a preferred solution is to minimize the land surface or undimpled surface of the ball. The '136 patent also discloses that this minimization should be balanced against the durability of the ball. Since as the land surface decreases, the susceptibility of the ball to premature wear and tear by impacts with the golf club increases. Hence, there remains a need in the art for a more aerodynamic and durable golf ball.

SUMMARY OF THE INVENTION

Accordingly, the present invention is directed to a golf ball with improved dimples. The present invention is also directed to a golf ball with improved aerodynamic characteristics. These and other embodiments of the prevent invention are realized by a golf ball comprising a spherical outer land surface and a plurality of dimples formed thereon.

The invention provides for at least one dimple having a protrusion formed on an inner surface, the protrusion comprising a plurality of rotational elements whereby a boundary layer of air flowing over the surface of the dimples is energized. The rotational elements are fully contained within a dimple perimeter such that no part of the protrusion extends beyond a chordal plane of the dimple.

One embodiment provides a plurality of rotational elements such that a cross-section of the diameter will be different at a minimum of two locations.

An acceptable number of rotational elements is determined by the number of dimples on the golf ball, such that:

$$N_E \leq \frac{4000}{N_D}$$

wherein:

$N_E$ is the acceptable number of rotational elements, and $N_D$ is the number of dimples on the golf ball.

The final dimple layout is defined by:

$$V_D = V_O - (N_E V_E)$$

Wherein:

$V_D$ is the chordal dimple volume $V_O$ is the phantom chord volume $V_E$ is the elemental volume of the protrusion.

Each dimple maintains an effective theoretical edge angle controlled by the dimple volume. Preferably, the effective theoretical edge angle is between 9° to 18°, and more preferably it is between 12° to 16°.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
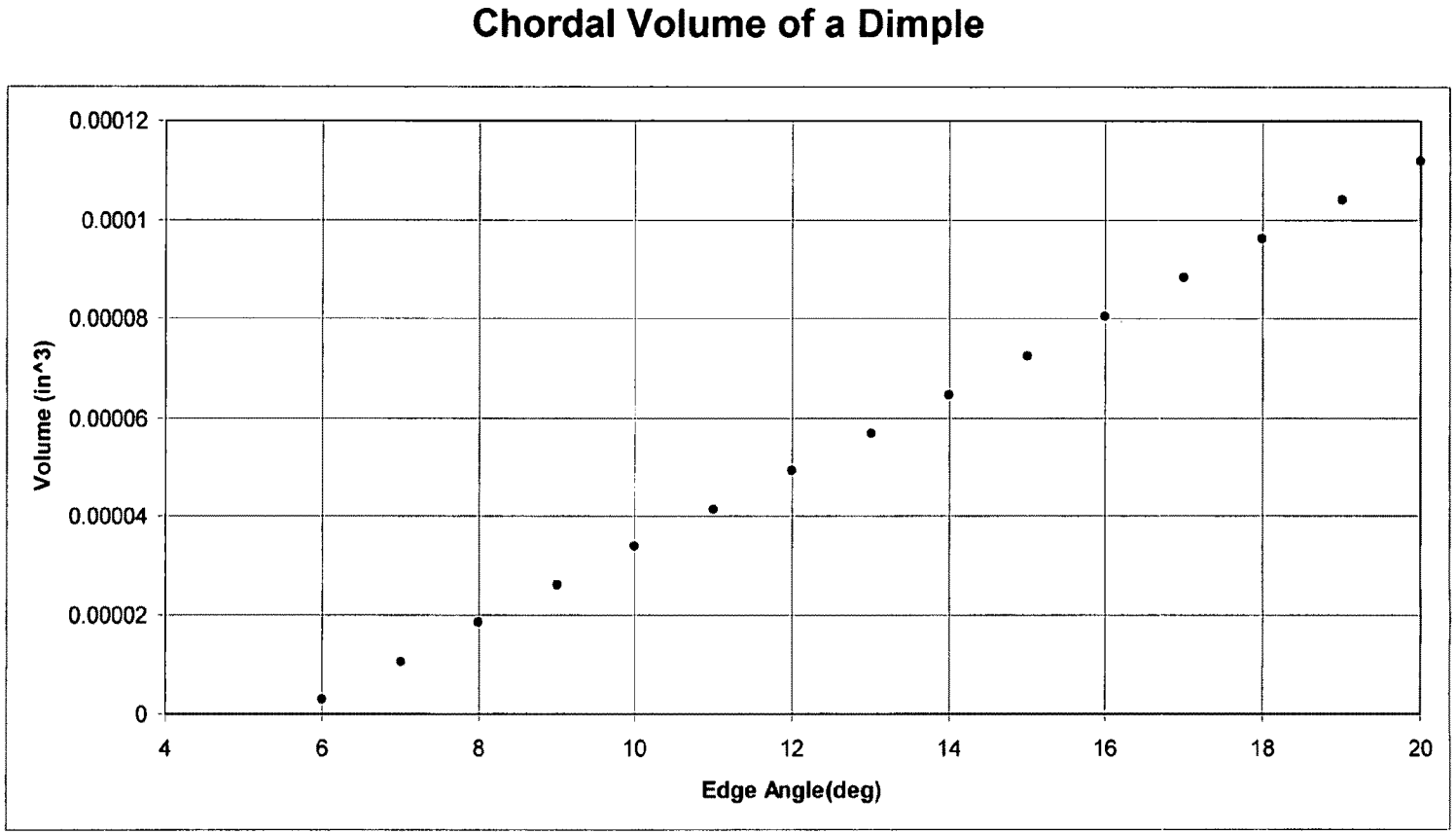
FIG. 1 is a chart depicting the chordal volume of a dimple as a function of the dimple edge angle.

As shown generally in FIG. 1, where like numbers designate like parts, reference number 10 broadly designates a golf ball 10 having a plurality of dimples 12 separated by outer undimpled or land surface 14.

In accordance to one aspect of the present invention, the inner land surface 18 of dimples 12 may include protrusions comprising of rotational elements 16 to further agitate or energize the turbulent flow over the dimples 12 and to reduce the tendency for separation of the turbulerit boundary layer around the golf ball in flight. As described below, the protrusions may have many shapes and sizes, as long as they contribute to the agitation of the air flowing over the dimples and conform to the theory and design of the present invention.

Figure 3:
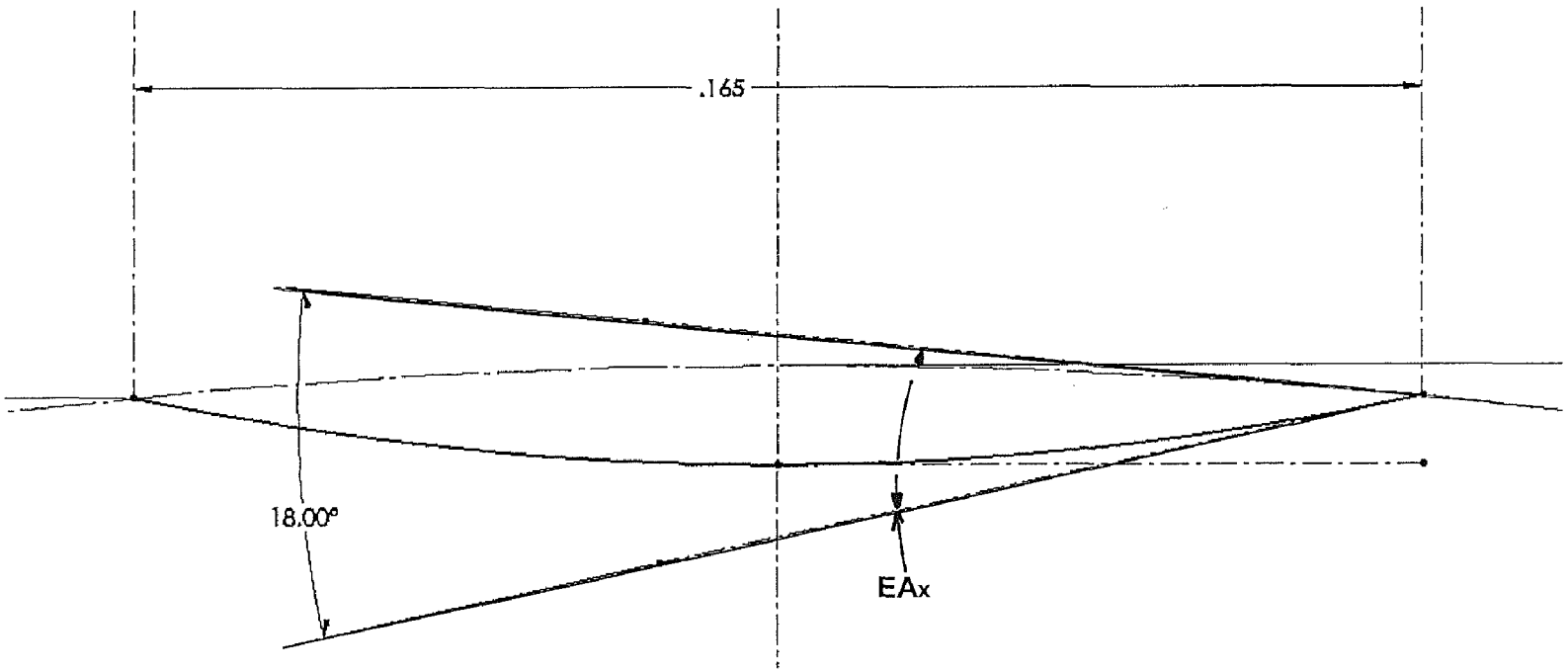
FIG. 3 is a schematic of a dimple profile.

FIG. 3 illustrates rotational elements 16 disposed on the land surface 18 of the dimple 12. As used herein, the land surface 18 of the dimple 12 is the concave surface of the dimple unaffected by the rotational elements defined on the dimple 12. For spherical dimples, the land surface 18 is spherical or arcuate. The land surface 18 may also be flat or may have any irregular shape known in the art. As taught in the '136 patent, the circumference of the dimples 12 optimizes the aerodynamic performance of the golf ball. Similarly, the perimeter of the protrusion elements 16 also contributes to and improves the aerodynamics of the golf ball. Advantageously, the protrusions of the present invention remedy a design issue known in the art, i.e., minimizing the land surface 14 of the golf ball for better aerodynamics but without increasing the wear and tear on the ball during repeated impacts by the golf clubs. In accordance to the present invention, the aerodynamic performance is increased by increasing the agitation of the boundary layer over the dimpled surfaces, and the land surface 14 may remain robust to resist premature wear and tear.

The present invention describes rotational elements 16 contained within the dimple perimeter and below the spherical ball surface. Dimples with protrusion type rotational elements provide further aerodynamic flight tuning to conventional dimple layouts with circular perimeter boundaries. Further, these profiles can provide an aesthetically unique dimple pattern.

The dimples on a golf ball of the present invention are determined by:

(1) A defining cross-sectional shape;

(2) A protrusion that is fully contained within the dimple perimeter with no part of the protrusion extending beyond the chord plane of the dimple;

(3) A protrusion with several rotational elements (greater than one) such that the cross-section of the dimple is different at a minimum of two locations; and (4) When determining the acceptable number of rotational elements ($N_E$) within the dimple first determine the number of dimples on the golf ball ($N_D$) such that:

$$N_E \leq \frac{4000}{N_D} \qquad \text{Equation 1}$$

This allows for more rotational elements in low count dimple patterns and less in high count patterns. Further, it allows the flexibility to adjust the flight of the golf ball by using rotational elements while maintaining ideal aerodynamic performance.

(5) The final layout of the dimple 12 must be defined such that when we consider all of the components in steps 1-4 above, the phantom chord volume ($V_O$) of the defining shape mentioned in (1) above, and the elemental volume of the protrusion ($V_E$), we get a chordal dimple volume ($V_D$) defined by equation 2. The elemental volume may need to be determined using CAD software depending on its shape and complexity:

$$V_D = V_O - (N_E V_E) \qquad \text{Equation 2}$$

(6) The dimple volume $V_D$ in (5) must be such that each dimple maintains an effective theoretical edge angle ($EA_X$). The effective theoretical edge angle is determined by computing the equivalent spherical dimple edge angle with dimple volume $V_D$ on the golf ball with a diameter ($D_B$). The dimple diameter ($D_D$) is the weighted average for the specific pattern. It should be noted that this does not imply or limit the plan view dimple profile to be circular. In cases, where the dimples are not circular a maximum average is computed.

The following equations are defined for the purpose of illustration:

Spherical Dimple Volume $$V_C = \pi(d_C^2)\frac{(3R_D - d_C)}{3} \qquad \text{Equation 3}$$

Chord Depth $$d_C = R_D\left(1 - \sin\left(\cos^{-1}\left(\frac{D_D}{2R_D}\right)\right)\right) \qquad \text{Equation 4}$$

Dimple Radius $$R_D = \frac{-D_D}{2\cos\left(EA_{SD}\frac{\pi}{180} + \cos^{-1}\left(\frac{D_D}{D_B}\right)\right)} \qquad \text{Equation 5}$$

(Where $EA_{SD}$ is the edge angle of a spherical dimple.)

For a given dimple, the chordal volume has a linear relationship to the edge angle ($R^2$=1). By way of example, assume the pattern has an mean dimple diameter of 0.165 inches. A plot of dimple volume versus edge angle is shown in FIG. 1.

It is to be appreciated that the edge angle is the sum of the chordal and cap angles. When the chordal angle is zero, the chordal volume is also zero, however the edge angle is equal to the cap angle. For this reason, the plot only makes sense for edge angles greater than the cap angle for a given dimple diameter (5.64° in this case). The plot shows the linear relationship between chordal volume and edge angle. This information will be used to determine the effective theoretical edge angle.

The linear equation is determined as follows: use equations 3, 4, and 5 to find the volume $V_B$ when the edge angle $EA_{SD}$ is equal to zero. This is the y-intercept of the linear equation.

Use Equations 3-5 to find the volume $V_2$ for any non-zero edge angle $EA_2$. Then calculate the slope (m) of the line with the two points, by utilizing the following equation:

$$m = \frac{V_2 - V_b}{EA_2} \qquad \text{Equation 6}$$

Using dimple volume $V_D$, from step 5 above, and equations 7 and 8, the effective theoretical edge angle $EA_x$ may be calculated.

$$V_D = mEA_x + V_b \quad \text{Equation 7}$$

$$EA_x = \frac{V_D - V_b}{m} \quad \text{Equation 8}$$

The dimple should be designed such that the effective theoretical edge angle $EA_x$ satisfies equation 9 below.

$$9° \leqq EA_X \leqq 18° \quad \text{Equation 9}$$

And more preferably:

$$12° \leqq EA_X \leqq 16° \quad \text{Equation 10}$$

Example A

Figure 2:
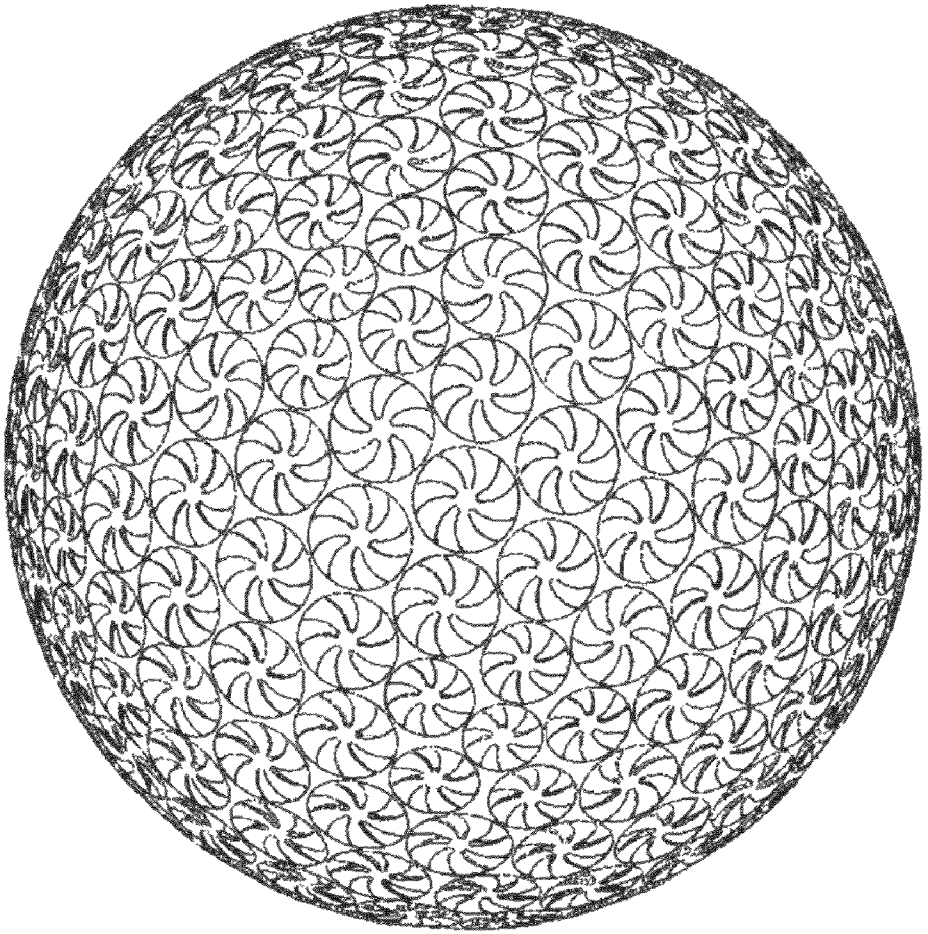
FIG. 2 is a symmetrical view of a golf ball having allowable rotational elements.

As seen in FIG. 2, a golf ball is shown having 272 dimples ($N_D$=272). Equation 1 can be solved for the number of allowable elements ($N_E$) to be patterned within each dimple.

$$N_E \leq \frac{4000}{272}$$

Allowing for rounding, $N_E$<15, so the 5 rotational elements shown in FIG. 2 are well within range of allowable rotational elements.

Figure 4:
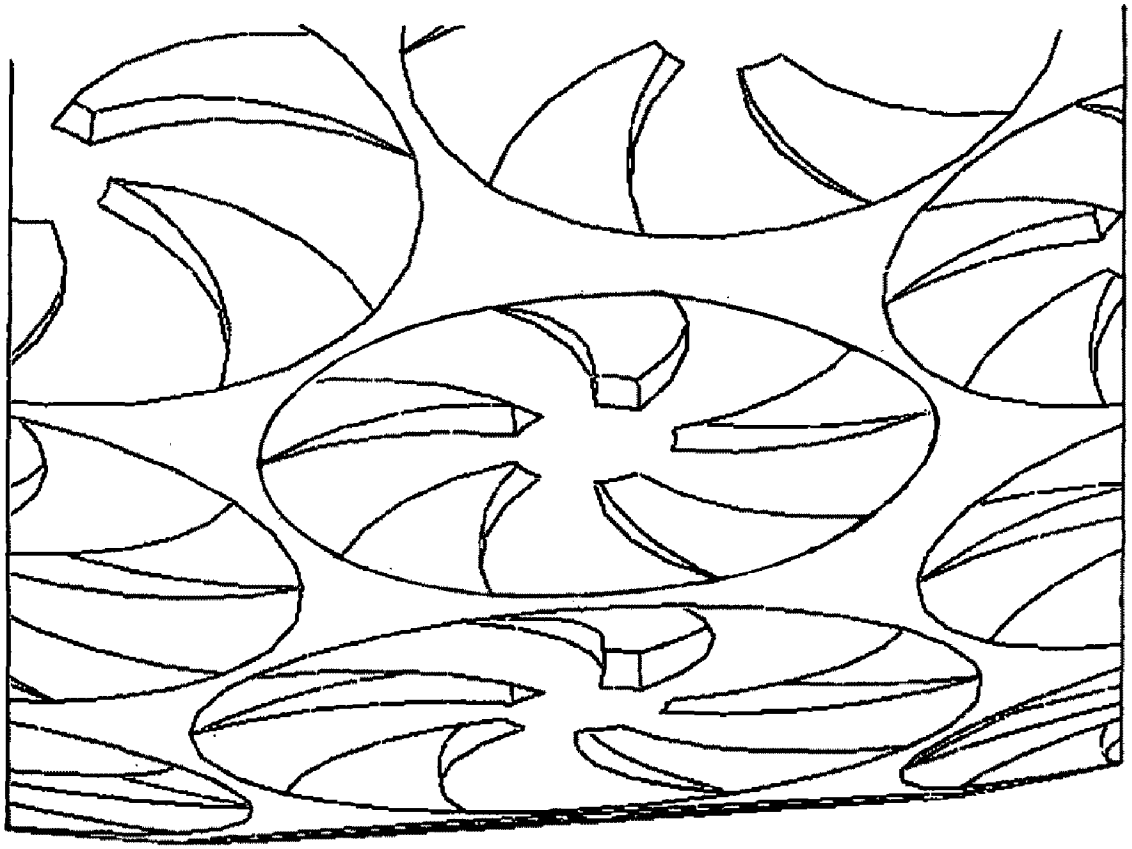
FIG. 4 is a sectional view of an embodiment having rotational elements confined within dimples of a golf ball.
Figure 5:
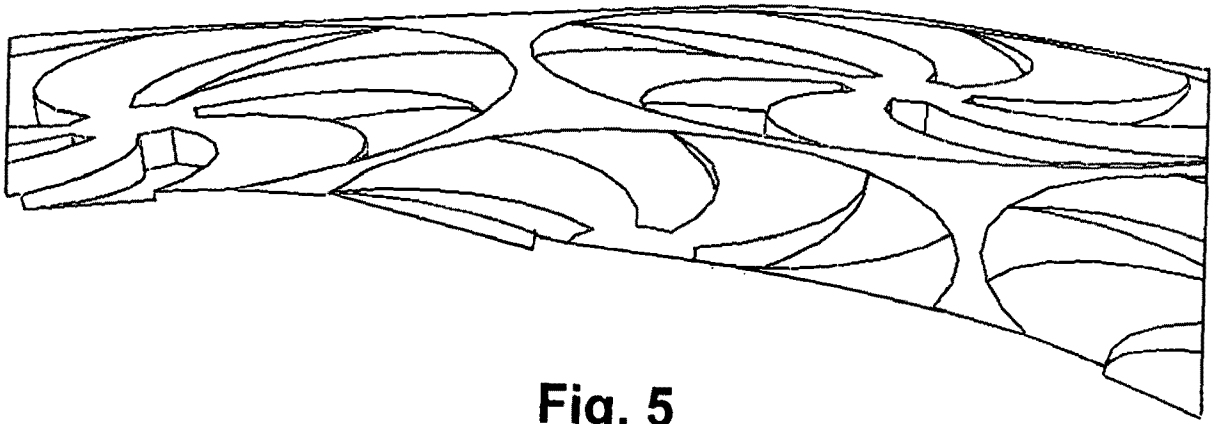
FIGS. 5 and 6 present two cross-sections of a dimple.
Figure 6:
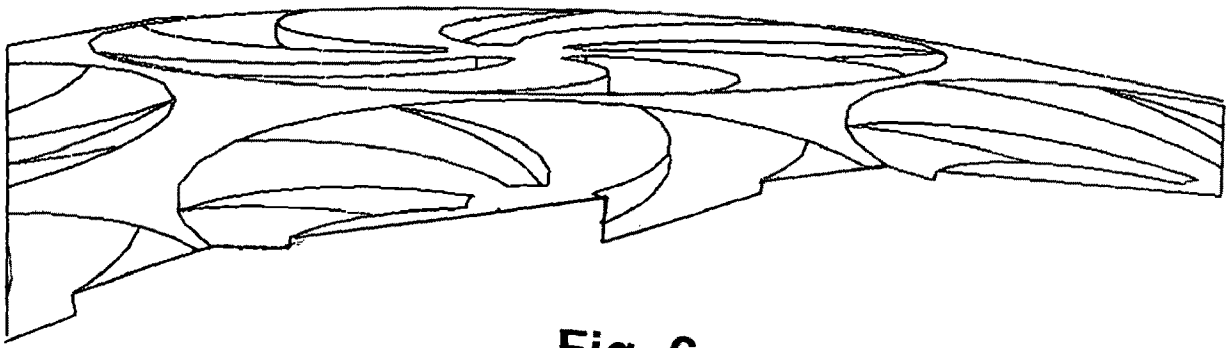

The dimple design begins by defining an encompassing cross-sectional shape in which the rotational elements are defined. For this example, each spherical dimple has an edge angle of 18° and a diameter of 0.165 inches as the defining dimple profile as shown in FIG. 3. Assuming a ball diameter ($D_B$) of 1.68 inches, the phantom chord volume ($V_O$), like that mentioned in Equation 2, of the spherical base shape is 9.59×10 in$^3$. The dimple pattern used for this evaluation is shown in FIGS. 4-6 with FIGS. 5 and 6 being two cross-sections of the dimple. These show that the dimple has differing cross-sections at a minimum of two points, and that the rotational elements in the dimple do not exceed past the chord plane of the base dimple shape.

Figure 7:
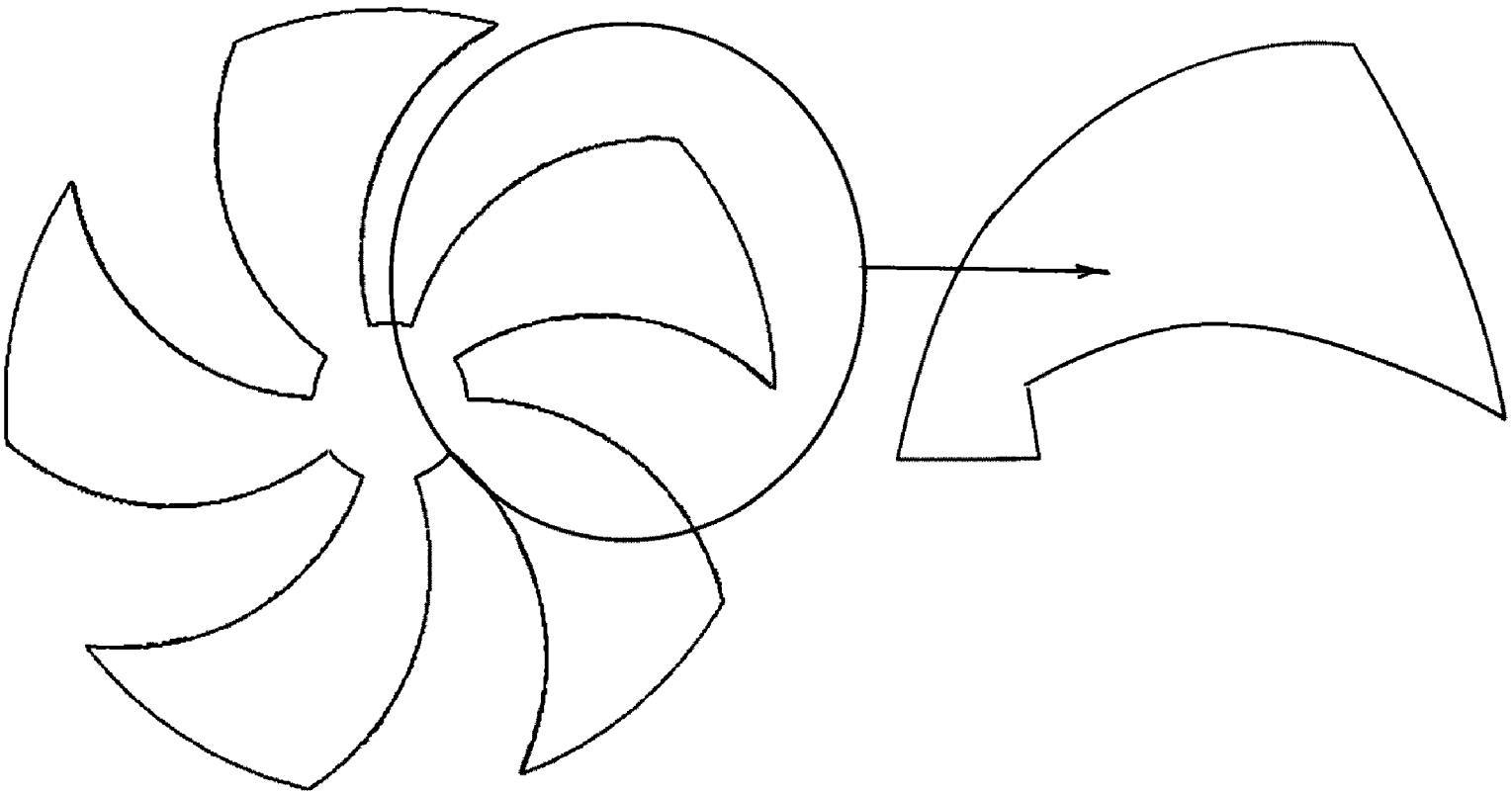
FIG. 7 shows a dimple reduced to a single element that is identical to the other four elements that make up the dimple.
Figure 8:
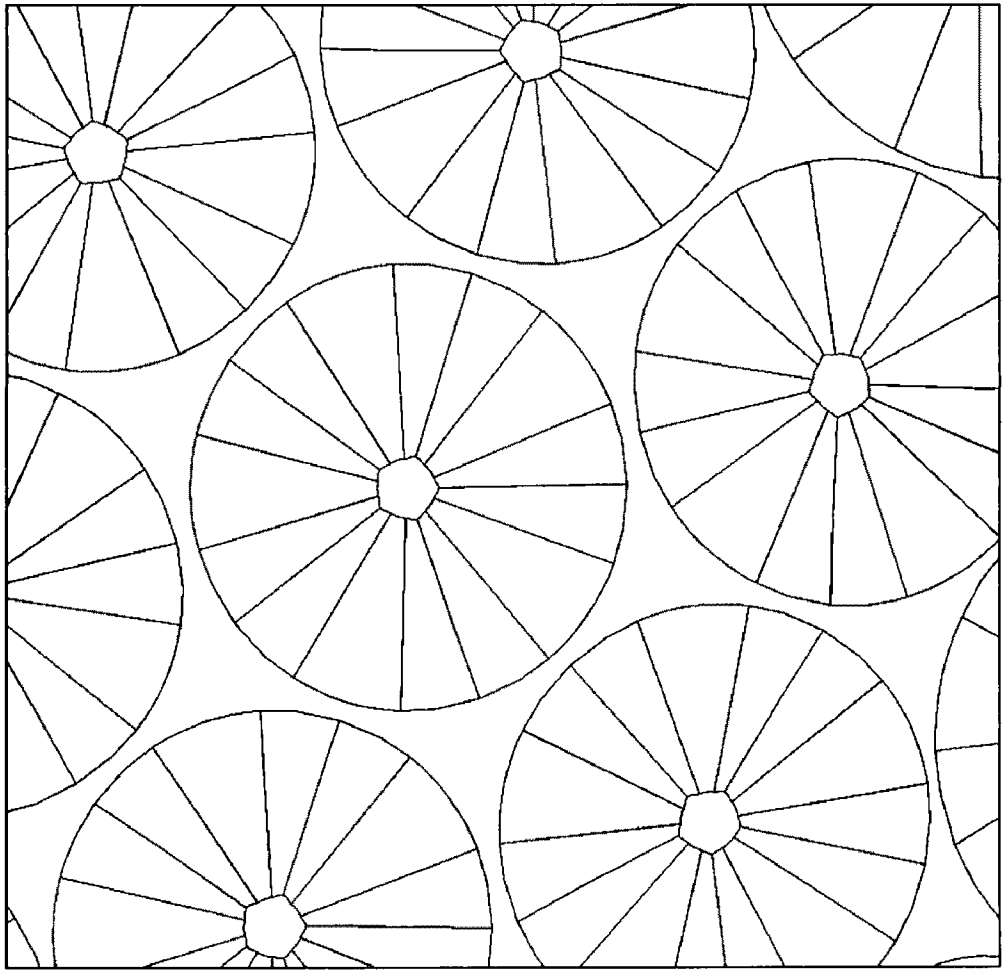
FIGS. 8-9 are examples of alternative rotational protrusions.
Figure 9:
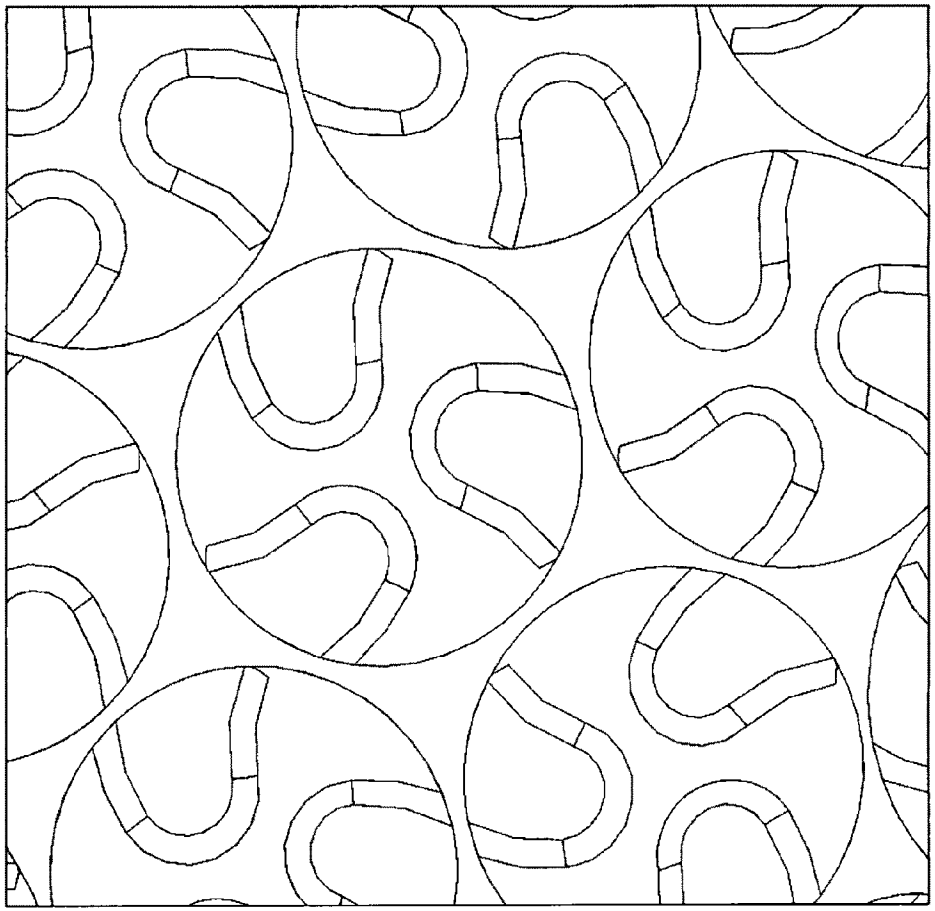

Using CAD software, the dimple X as shown in FIG. 7 is reduced to a single element X that is identical to the four other elements necessary to make the dimple, with the elemental volume ($V_E$) determined to be 1.13×10 in$^3$. Equation 2 can then be used to solve for the final dimple volume $V_D$:

$$V_D = 9.59\times10^{-5} - (5\cdot1.13\times10^{5})$$

$$V_D = 3.94\times10^{-5}\ \text{in}^3$$

To get the correct linear equation the y-intercept ($V_b$) is solved for by using Equations 3, 4, and 5.

$$R_D = \frac{-D_D}{2\cos\left(EA_{SD}\frac{\pi}{180} + \cos^{-1}\left(\frac{D_D}{D_B}\right)\right)}$$

$$D_D = 0.165$$

$$EA_{SD} = 0$$

$$D_B = 1.68$$

$$R_D = -.84$$

$$d_C = R_D\left(1 - \sin\left(\cos^{-1}\left(\frac{D_D}{2R_D}\right)\right)\right)$$

-continued $$d_C = -.0041$$

$$V_b = \pi(d_C^2)\frac{(3R_D - d_C)}{3}$$

$$V_b = -4.35\times10^{-5}$$

Solve for $V_2$ when $EA_2$ is 14°

$$V_2 = 6.46\times10^{-5}$$

Use equation 6 to find the slope of the line (m):

$$m = \frac{V_2 - V_b}{EA_2}$$

$$m = \frac{V_2 - V_b}{EA_2}$$

While various descriptions of the present invention are described above, it is understood that the various features of the embodiments of the present invention shown herein can be used singly or in combination thereof. This invention is also not to be limited to the specifically preferred embodiments depicted therein.

What is claimed is:

1. A golf ball having recessed dimples on the surface thereof, wherein at least one dimple is defined by a protrusion formed on an inner surface, the protrusion comprising a plurality of rotational elements whereby a boundary layer of air flowing over the surface of the dimples is energized, wherein an acceptable number of rotational elements for each dimple is determined by the number of dimples on the golf ball, such that:

$$N_E \leq \frac{4000}{N_D}$$

and, wherein a final dimple layout is defined by:

$$V_D = V_O - (N_E V_E)$$

wherein:

$N_E$ is the acceptable number of rotational elements for each dimple;

$N_D$ is the number of dimples on the golf ball;

$V_D$ is the chordal dimple volume;

$V_O$ is the phantom chord volume; and $V_E$ is the elemental volume of the protrusion.

2. The golf ball of claim 1, wherein the plurality rotational elements is fully contained within a dimple perimeter such that no part of the protrusion extends beyond a chordal plane of the dimple.

3. The golf ball according to claim 1, wherein a cross-section of the plurality of rotational elements within the dimple perimeter provides for the cross-section to be different at a minimum of two locations.

4. The golf ball according to claim 1, wherein each dimple maintains an effective theoretical edge angle controlled by the dimple volume.

5. The golf ball according to claim 4, wherein the effective theoretical edge angle is between 9° to 18°.

6. The golf ball according to claim 5, wherein the effective theoretical edge angle is between 12° to 16°.

* * * * *